US005291175A

United States Patent [19]

Ertmer et al.

[11] Patent Number: 5,291,175

[45] Date of Patent: Mar. 1, 1994

[54] LIMITING HEAT FLOW IN PLANAR, HIGH-DENSITY POWER RESISTORS

[75] Inventors: Donald W. Ertmer, Carpentersville; Lawrence D. Gleason, Hoffman Estates; Louis E. Roberts, Glenview, all of Ill.

[73] Assignee: Ohmite Manufacturing Co., Skokie, Ill.

[21] Appl. No.: 952,809

[22] Filed: Sep. 28, 1992

[51] Int. Cl.[5] ..... H01C 1/08

[52] U.S. Cl. ..... 338/59; 338/7; 338/53; 338/220

[58] Field of Search ..... 338/7, 53, 51, 57, 59, 338/234, 220

[56] References Cited

U.S. PATENT DOCUMENTS 3,497,859 2/1970 Bang ..... 338/309
4,256,796 3/1981 Hang et al. ..... 428/210
4,333,069 6/1982 Worth et al. ..... 338/315
4,658,234 4/1987 Takayanagi ..... 338/260
4,939,498 7/1990 Yamada et al. ..... 338/220 X

*Primary Examiner*—Marvin M. Lateef
*Attorney, Agent, or Firm*—Eugene I. Snyder

[57] ABSTRACT

A chip resistor whose resistive element provides a power density of at least 20 watts per square inch is provided with an air gap between the resistance element and the electrical contact junctions of the conductive strips electrically connected to the resistance element and terminals attached to the chip resistor. The air gap has a length approximately 70% of the distance between opposing edges of the planar body forming the chip to so restrict heat flow as to prevent the electrical contact junctions from exceeding a temperature of about 175° C. when the resistive element is at a temperature of 350° C. or more.

13 Claims, 2 Drawing Sheets

LIMITING HEAT FLOW IN PLANAR, HIGH-DENSITY POWER RESISTORS

BACKGROUND OF THE INVENTION

This application relates to power resistors. More particularly, the application relates to power resistors commonly referred to as chip power resistors. Specifically, it relates to limiting heat flow in chip power resistors having a continuous power density greater than about 20 watts per square inch so that while that portion of the resistor where the resistive element is located remains rather hot, the terminals of the resistor, the points of mechanical attachment of the terminals to the chips, and in particular the points of electrical contact between the terminals and the resistive zone remain relatively cool. Thus, whereas many electronic components seek to dissipate heat, we seek to prevent heat dissipation for reasons which will become readily apparent from the ensuing discussion.

For economy of both weight and space it is highly desirable to have electronic components as compact as possible. In the case of resistors, this means cramming a given resistance into an increasingly smaller space. Where the resistor is a chip resistor, which is a thin, flat, wafer-like article usually of rectangular shape, the thickness of the resistor is small relative to its other dimensions and the thickness of the resistive portion, generally deposited as a film on the chip substrate, is even more negligible relative to its other dimensions. Consequently, one is effectively packing a given resistance into smaller and smaller areas as the chip size decreases and increasing the power density as the unit becomes smaller. Attending this increase in power density is an increase in surface operating temperature in that region containing the resistive element, and until relatively recently the availability of economical chip substrates which could withstand the thermal extremes of cyclic on-off operation provided a practical limitation to decreasing resistor size.

In recent years materials with suitable coefficients of thermal expansion and with excellent mechanical and electrical properties have become commonly available, and when used as chip substrates these have afforded the opportunity to further decrease resistor size. Exemplars of such materials are porcelain or glass-coated metals. For example, the substrates of Hang et al., U.S. Pat. No. 4,256,796 are comprised of a metal core, such as steel, coated with a porcelain. The porcelain components are applied to the metal core and fired to provide a partially devitrified porcelain coating on the metal where the resulting substrate has a deformation temperature of at least 700° C. and a coefficient of thermal expansion of at least $110\times10^{-7}/°$ C. Such substrates when used as base materials for chip resistors permit fabrication of resistors having a continuous power density greater than 20 watts per square inch. But accompanying this increase in power density are other features whose origins and effects require a brief excursion into the land of chip resistor fabrication to better understand the problem with which we are faced.

FIG. 1 is a general schematic representation of a chip resistor. The underlying chip substrate, 1, has a resistive region, 2, which generally is a film of a conductor or semiconductor deposited on the chip surface. The resistive region is bounded by conductive strips, 3, which are in electrical contact with the resistive region. To the chip substrate are securely attached terminals, 4, which are in electrical contact with the conducting strips, 3, most often via a solder junction here represented as 5. All or part of this assembly may have an overglaze or glass coating which affords mechanical and environmental protection to the assembly elements. However, as this protective feature is unrelated to our invention, we shall not refer to it any further.

At the high power densities of interest here the shaded resistive region may easily attain temperatures of about 350° C. This presents no problem for the underlying chip substrate, since the material was developed to readily withstand such temperatures and the thermal shock attending frequent and rapid cycling between ambient temperature and 350° C. However, especially where the substrate is a porcelain coated metal, there is heat transfer from the resistive region of the chip to the terminals region, largely via conduction through the metal. Thus, the terminals may readily attain temperatures greatly in excess of 100° C., which constitutes a major problem since many circuit boards into which the chip resistors may be incorporated deteriorate at temperatures over about 100° C. Furthermore, solder connections also begin to deteriorate at a temperature in the region of 150°-200° C., which is a temperature readily attained in the high power density chip resistors under discussion, leading to a variable and uncertain resistance value and finally an open circuit at the junction of the terminals and the conductive strips.

The aforementioned problems are so severe that in our experience chip resistors with a power density of 20 watts per square inch or greater usually fail after only several days use, which is unquestionably an unacceptable performance standard. The result to be achieved was clear; decrease heat transfer from the 350° C. resistive region of the chip resistor so that the terminals remain under about 100° C. and the solder junction of the terminal to the resistance portion remain under about 175° C., and attain this result without any significant change in chip size, chip weight, or chip electrical performance. This application is directed toward a relatively simple solution to the problem.

As previously stated, heat transfer from the resistive region of the chip to the terminal region occurs largely via conduction through the chip substrate, and where a porcelain coated metal is the chip substrate the heat conducting medium is mainly the metal, since the metal is a far better heat conductor than is the porcelain overcoat. The solution to the problem is to reduce heat conduction from the heat generating resistive region of the chip resistor to the terminal region(s) of the resistor. Stated differently, a general solution utilizes locating means for reducing heat conduction between the resistive (heat source) and terminal (heat target) regions of the chip resistor. We have further found that an air gap is an effective, convenient, and inexpensive means for reducing heat conduction, i.e., that one can effectively limit heat transfer between the resistive and terminal regions of a chip resistor by having an air gap between the regions. In effect, the air gap acts as an insulator limiting heat flow by restricting the cross-sectional area of the "heat pipe" between the two regions. Stated differently, the air gap of our invention increases thermal resistance in the zone between the resistive and terminal regions, thereby decreasing heat flow from its source to the terminals.

The prior art does not appear to have any teachings suggesting our general or our specific solution to the stated problem, nor does there seem to be teachings in any way related thereto. For example, U.S. Pat. No. 3,497,859 teaches a planar resistor having a recess at its underside to provide a gap between the mounted resistor and the surface of a printed circuit board. The recess was provided to help distribute current over the face of the body and to provide a passage between the resistor and the circuit board for one or more electrical conductors to pass without contacting the resistor. The recess also made it unnecessary to cover the resistor with electrical insulation. It can be readily seen that there are critical and important functional differences between the patentees' teachings and our invention to be described. First, the gap is between a mounted resistor and a printed circuit board, and is not on the chip resistor itself. Secondly, the gap serves entirely different purposes wholly unrelated to that in our invention. It is clear that the skilled worker having this reference before him would have no inkling of the solution to the problem applicants faced.

Worth et al. in U.S. Pat. No. 4,333,069 show a wire wound resistor whose terminals have a gap therein for decreasing the weight and increasing the flexibility of the resistor in order to allow spatial adjustments for openings in printed circuit boards. Takayanagi, U.S. Pat. No. 4,658,234, discloses a resistor network having a plurality of resistor elements disposed parallel to each other in an insulation substrate and enclosed in a resin seal that encloses both the substrate and the resistor elements. The resin enclosure prevents effective heat dissipation leading to deteriorating performance. This was solved in part by providing the resin seal with a plurality of heat-dissipating holes extending through the resin seal and formed between the selected resistor elements. It is readily seen that the patentees "holes" offer the purpose of heat dissipation, which is precisely opposite the function of the air gap in our invention.

SUMMARY OF THE INVENTION

The purpose of this invention is to provide means for keeping cool the terminals and their solder connections in a chip resistor with a continuous power density of at least 20 watts per square inch. An embodiment comprises a chip resistor having means for reducing heat conduction located between the resistive and terminal regions of the resistor. A specific embodiment comprises a chip resistor where said means is an air gap between the resistive and terminal regions. In a more specific embodiment the length of the gap is at least 70% of the width of the chip in the resistive region adjacent to the air gap. In a yet more specific embodiment, the chip substrate is a porcelain coated metal. In a still more specific embodiment the chip substrate is a porcelain coated steel and the air gap is at least 75% of the chip width in the resistive region adjacent to the air gap.

DESCRIPTION OF THE INVENTION

Figure 2:
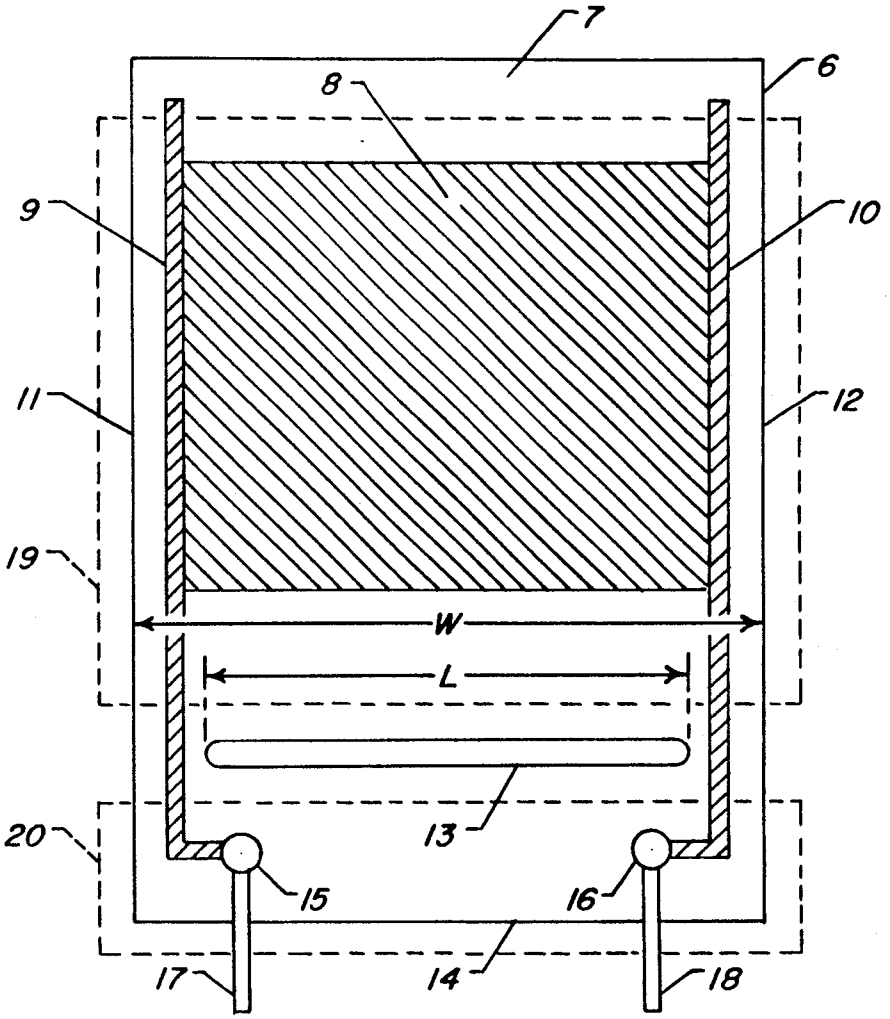
FIG. 2 is a top schematic view of an embodiment of a chip resistor according to this invention having a slot between the resistive and terminal regions acting as a heat conduction reducing means.
Figure 1:
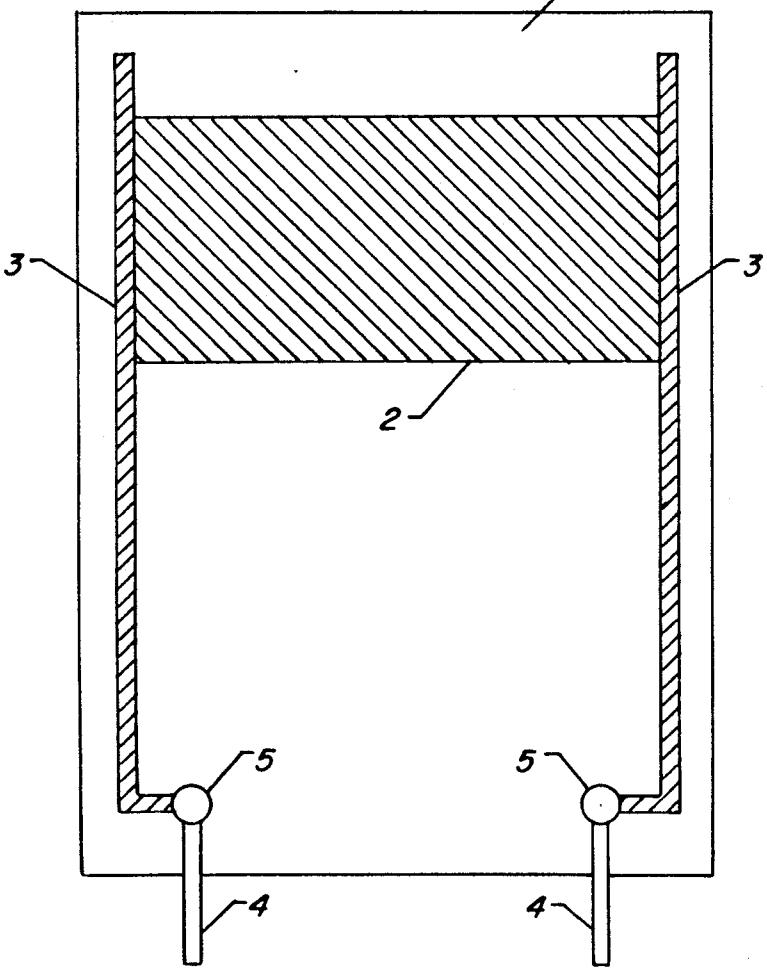
Figure 1 (Prior Art)
FIG. 1 shows a top schematic view of a conventional prior art chip resistor.

As we have previously stated the problem to be solved is to limit the heat flow from the resistive region of a chip resistor with a continuous power density of at least 20 watts per square inch to the terminal region(s) so that the terminals always remain under about 100° C. and the solder junctions remain under about 175° C. Our solution to this problem is to provide a means for reducing heat conduction from the resistive region of the chip resistor, which is the heat source, to the terminal region(s) of the chip resistor, which is the heat target, and to locate such means between the resistive and terminal regions. We have found that an air gap is an effective means of reducing heat conduction between the resistive and terminal regions of a chip resistor, and as is sometimes the case providing such means can be viewed not so much as a matter of adding a structure to the chip resistor as removing structure from the resistor. However this may be viewed, our solution to the stated problem is to provide as heat conduction reducing means an air gap and to locate the gap between the resistive and terminal regions, where the gap is at least 70% of the chip width in the resistive region adjacent to the air gap. As will become apparent from the following detailed description, means for reducing heat conduction may consist of a plurality of air gaps instead of but a single one, but the overall requirements and effects remain invariant with number.

A chip resistor is a thin, flat, wafer-like, generally planar body. It is most often rectangular in shape although the shape per se is not relevant to our invention. Solely for convenience and clarity of exposition we shall refer to the chip as generally rectangular in shape. The chip substrate is a dielectric material or a metal coated with insulating material to give it a dielectric surface. The substrate may be a ceramic, or a metal coated with glass or an oxide. The chip itself may be formed into the desired shape by stamping, by molding, or by other methods well known to one practicing the art. For the purpose of our invention it is only necessary that there be one electrically non-conducting surface of the planar body; the more usual situation is where both surfaces are non-conducting and unless specifically stated to the contrary the following description is crafted for the situation where both surfaces are non-conducting.

The resistance element is generally a thin layer or film of an electrically conducting resistance material which often is applied to a non-conducting surface of the chip substrate by screening, spraying or by brushing. It is possible to have two distinct resistors on a single planar body, with a separate and discrete resistive element on each of the two non-conducting surfaces of the substrate, although this is not the usual case. The resistive film can be applied in a pattern rather than by completely covering a portion of the area on one side of the planar body, and where such a pattern is desired it can be placed onto the substrate by, for example silk screening. The resistance material also can be applied as several discrete strips rather than as a continuous layer, and it needs to be emphasized that the success of our invention is independent of the particular form of the resistance element. A resistance circuit may be formed by printing a predetermined pattern of a resistance paste or ink and baking it on the substrate. After applying such an ink, the coating may be air dried, often at a temperature of 100°-150° C., for several minutes and then fired at a much higher temperature, for example, 750°-950° C., for another period of time in order to afford a film of a resistance element which is firmly attached to the substrate surface and which remains stable upon further use.

Conducting strips are located near two opposing edges of the planar body and usually are films of a good conducting material having no appreciable resistance relative to the resistance element. These conductive strips form the lateral boundaries of the resistive region and can be said to define an area bounded by the conductive strips within which the resistive element may be placed. In the more general case, the conductive strips partially enclose a resistive region and provide partial boundaries thereto. The conducting strips are in electrical contact with the resistance element but are otherwise not in direct electrical contact with each other. The conducting strips of a chip resistor are somewhat analogous to the conductive leads in, for example, a conventional carbon resistor.

Each conductive strip is also in electrical contact with a terminal. The two terminals each are of electrically conducting material and are securely mechanically attached to the chip itself. The terminals generally are arranged as projecting laterally from an edge which is different from either of the two opposing edges proximate to which the conducting strips are placed. However, this arrangement, although the most usual one, is not a necessary one; vide infra. Similarly, the terminals are generally parallel disposed in relation to each other although this, too, is not a necessary condition but just a convenient and conventional one. As previously stated, in addition to the terminals being mechanically attached to the chip, each terminal is in electrical contact with one of the conducting strips, most often via a solder junction, and each terminal is in electrical contact with a different conducting strip.

All of the aforementioned elements are usually provided with mechanical and environmental protection. Frequently this function is served by an overglaze ink, which is a composition that can be coated onto the surface of the chip and over the aforementioned elements and which upon firing at a temperature less than that used for the conductive and resistive films forms a glass layer impervious to humidity and which protects the elements against abrasion as well as chemical attack by corrosive elements in the atmosphere.

To this point our description has been one of a conventional chip resistor. The point of departure in our invention is the presence of means for reducing heat conduction between the heat source or resistive region and the heat target or terminal region of the resistor. A simple means for reducing heat conduction between the pertinent regions is an air gap which, for reasons of economy and universality, is the preferred means in the practice of our invention. The reason an air gap functions so well as a heat conduction reducing means is because air is a poor heat conductor relative to the material of the chip substrate itself, e.g., a metal coated with glass. The shape of the air gap is not per se important, but for convenience the air gap frequently will be in the form of a slot, generally rectangular in appearance, often with rounded ends. If we define the overall direction of heat flow from the resistive region to the terminal region as D, what we find as the critical element in our invention is the length of the air gap in the direction perpendicular to D relative to the width of the resistive region, i.e., edge-to-edge distance, immediately adjacent to the air gap in the same direction perpendicular to D. More particularly, we have found that if the length of the air gap is at least 70% of the width of the resistive region immediately adjacent to the air gap, then heat transfer from the resistive region to the terminal region is sufficiently impeded to keep the terminals and the electrical junctions between the terminals and conductive strips cool enough to permit repeated thermal cycling without significantly reducing the useful lifetime of the chip resistor. Where the dimension of the air gap is 75%, or even better 80%, of the dimension of the pertinent resistive region performance is still better.

The foregoing observation is perhaps more readily understood when it is recalled that conductive heat flow from the source resistive region to the target terminals region—which is by far the most important mechanism of heat transfer between the two regions—is proportional to the heat transfer conducting area, i.e., the area along which heat must flow to be transferred by conduction from the resistive to the terminals region. Thus, if all other variables remain constant and one reduces the heat transfer conducting area by one-third the heat flow between the regions will be reduced by one-third; if one reduces the heat transfer conducting area by one-half the heat flow will be reduced by one-half; and so on. The observation that where the length of the air gap is at least 70% of the length of the resistive region adjacent to the air gap is tantamount to saying that the heat transfer conducting area is reduced by 70%, the implicit assumption being that heat conduction by the air gap is negligible. Our invention can now be restated somewhat differently. In a chip resistor having a continuous power density of at least 20 watts per square inch the terminals and their solder junctions can be maintained at temperatures sufficiently low to afford long resistor performance life by reducing the heat transfer conducting area by at least 70% at some location between the heat source (resistive region) and the heat target (terminals region). A reduction of the heat transfer conducting area by 75% is preferable, and a reduction of the heat transfer conducting area by 80% is even more preferable. In this more general statement it is apparent that the particular means for reducing the heat transfer conducting area is immaterial, as is the number and placement of such means. The pith of our invention is achieving at least a 70% reduction in the heat transfer conducting area.

Our invention can be more readily understood and appreciated by a detailed examination of some of the figures, and especially FIG. 2 which is a schematic representation of perhaps the most common variant of our invention. As mentioned above, and as will be further stressed within, our invention is capable of numerous variants which are largely a matter of choice for the practitioner. However, for ease and clarity of exposition we shall restrict detailed comments to our preferred embodiment while indicating their pertinence to other embodiments currently less favored.

Referring to FIG. 2, 6 shows a chip resistor whose generally planar body, 7, is a ceramic or, in a preferred mode, a porcelain coated metal, such as that described by Hang et al. in U.S. Pat. No. 4,256,796. On a surface of the body there is deposited a resistance element, 8, here shown as a solid mass but which can be in the form of any kind of pattern, as is shown by 28 in FIG. 3. It is also possible for the resistance element to be present as more than one segment, although usually there is no advantage to such an arrangement and in any event this can be thought of as being merely one of the forms included among the class of patterns which the element can assume. The key characteristics of the resistance element, whatever its appearance or form, are that the element is located on an electrically non-conductive surface of the chip substrate in a region between, or bounded by, conductive strips 9 and 10, and the element is in contact with each of these strips.

Conductive strip 9 is located proximate to edge 11 and conductive strip 10 is proximate to opposing edge 12. As FIGS. 3 and 4 make clear, this is not an indispensable prerequisite, but rather is a convenient arrangement. It is only necessary that the conductive strips partially enclose and thus define a resistive region and provide partial boundaries thereto. The conductive strips 9 and 11 are somewhat analogous to the leads of a conventional resistor, i.e., they serve as highly conductive connections leading away from the termini of a resistance element. The spacing between the conductive strips and their respective edges is not a particularly critical design element, hence no particular importance is attached to this feature. On edge 14 there are securely attached two terminals, 17 and 18, which project laterally from said edge. As the figure shows, the terminals are disposed in an approximately co-parallel relation and in the same plane as the planar body, which is a matter of convenience rather than an essential element of our invention necessary for its success. Terminals 17 and 18 are securely attached to the planar body 7 by means not otherwise shown but which are well known in the art and which include such means as riveting, eyeletting, staking, welding, crimping, and so forth.

In addition to being firmly secured to the planar body the terminals 17 and 18 are also electrically connected to the conducting strips by means of the junctions 15 and 16. Thus, the junction 15 serves to electrically bridge conductive strip 9 and terminal 17, and junction 16 serves as an electrical bridge between conductive strip 10 and terminal 18. In the most usual case the junctions are merely solder connections, although other, more elaborate means of electrically connecting the terminals and the conductive strips may be used as equivalent means.

The key feature of our invention is the air gap, 13, as the heat conducting reducing means which is placed between the resistance element 8 and the terminals 17 and 18. The air gap extends through the planar body from its upper surface, which is shown, to its lower surface, which is not shown. The long dimension of the air gap, l, is in a direction generally perpendicular to a line connecting the resistive region 19, i.e., the region of the resistor containing the resistance element, and the terminals region 20, i.e., the region containing the terminals and the junctions 15 and 16. Whereas the width of the air gap is not important (so long as it is wide enough to cause heat transfer across the gap to occur predominantly via conduction across the air gap) the value of the long dimension l of the air gap is a critical element of our invention. The dimension between the edges 11 and 12 immediately proximate to that portion of the air gap closest to the resistance element is labelled as w, and it is essential that l be at least 70% of w for our invention to perform effectively. It is even more preferable that l be at least 75% of w, and most preferable that l be at least 80% of w. Stated more generally, $l \geqq kw$, where k is at least 0.70, more preferably at least 0.75, and most preferably at least 0.80.

The effect of the air gap is to make heat conduction occur along a more constricted path within the planar body; conduction across the air gap is negligible because of the high thermal resistance of air relative to the materials of construction of 7, so that essentially all of the heat conducted from the resistive region 19 to the terminals region 20 must now occur along the narrow paths remaining which join the two regions, i.e., between edge 11 and the left-hand terminus of air gap 13 and between edge 12 and the right-hand terminus of air gap 13. Where all elements are symmetrically placed, in the case where $l=0.75w$ each of the aforementioned heat conducting paths will have 0.125 of the total heat conducting cross-section available in the absence of air gap 13.

Figure 3:
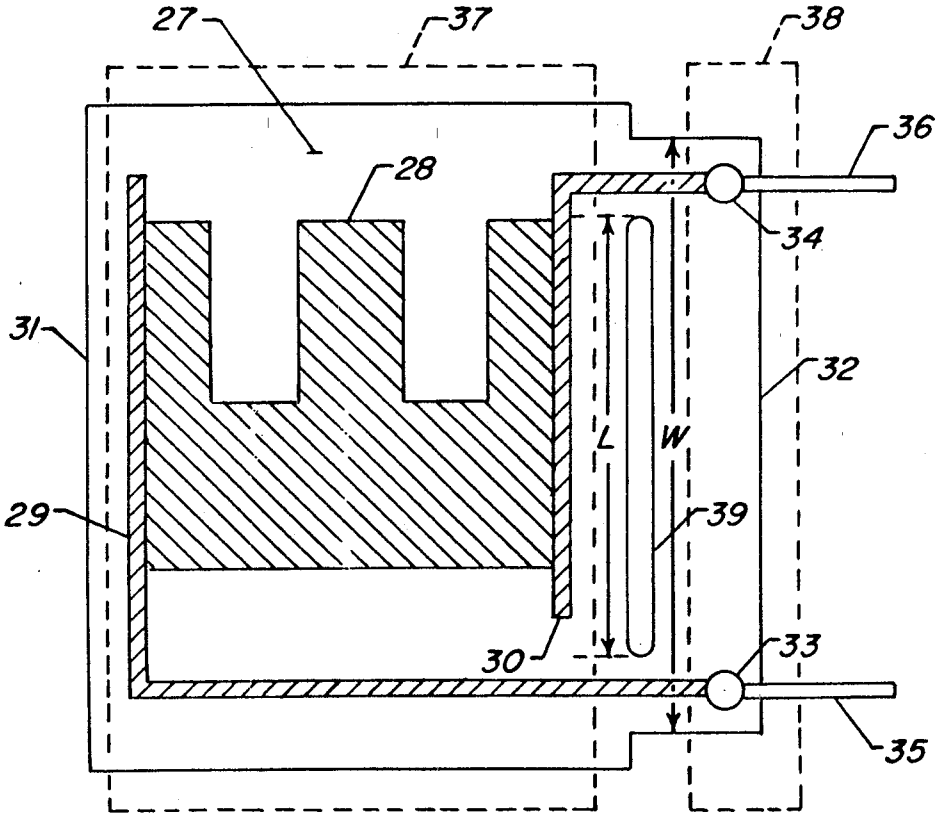

FIG. 3 shows another embodiment of our invention which incorporates several variants. Here the resistance element 28 is deposited as a pattern rather than as an unbroken, continuous layer on the surface of the planar body 27 between and in electrical contact with conducting strips 29 and 30. Conducting strip 29 is proximate to edge 31, but conducting strip 30 is not proximate to edge 32 and is removed substantially therefrom. Terminals 35 and 36 are securely attached to edge 32. Hence, in this embodiment the terminals are attached to an edge which is approximately co-parallel to one of the conducting strips rather than being affixed to one of the other edges. Junctions 33 and 34 provide electrical contact between the terminals and the conducting strips.

In this embodiment the resistive region is that within the dotted lines indicated by 37 generally, and the terminals region is that within the dotted lines indicated by 38 generally. The air gap is placed between the regions 37 and 38, and the dimension of the air gap, l, is the critical element relative to the dimension of the resistive region, w, immediately adjacent to the air gap. The requirement that l be at least 70% of w is essential to the success of our invention, whatever the particular embodiment.

Figure 4:
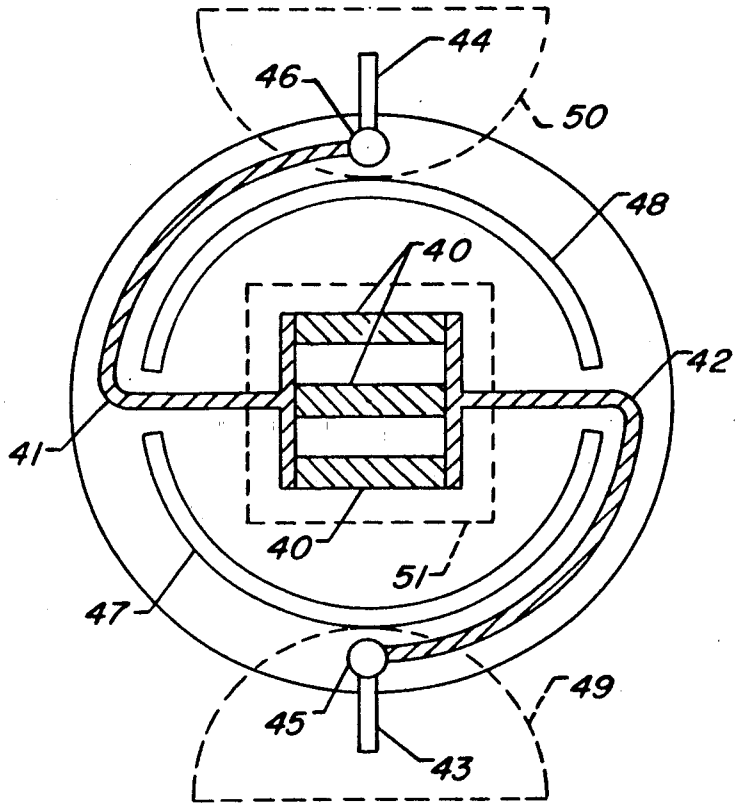
FIGS. 3 and 4 are top schematic views of alternative embodiments of a chip resistor according to this invention differing in the arrangement and form of the elements.

FIG. 4 shows yet another embodiment where the planar body is not rectangular, where the resistance element 40 is in the form of a series of strips or bands, where the conductive strips 41 and 42 are electrically connected to terminals 43 and 44 attached to the planar body on opposing "edges" via junctions 45 and 46. Note that in this case two separate air gaps 47 and 48 are required because there are two separate and distinct terminal regions, 49 and 50, which need to be insulated from the resistive region 51. Although this embodiment is not represented as having a particular advantage, it is shown to demonstrate that our invention is capable of many variations, all of which are encompassed within our claims.

The preparation of a porcelain coated chip resistor is well known in the art, and the following description is only illustrative of its method of fabrication. The chip resistor structural core consists of a commercial quality 24 gauge cold rolled steel with a carbon content of 0.008% or less to minimize the production of carbon dioxide bubbles in the porcelain coating which forces the coating to spall off of the metal. The metal is fabricated in the proper geometries by using a programmable high powered laser. The laser is used because it cuts metal without introducing any stress into the steel; if residual stress remains in the steel after fabrication, the coating may crystallize in such a manner as to follow the form of the stress and in many cases the coating will spall off of the steel. The structural geometries of the resistors are cut into arrays within 10×15 inch plates.

To assure a strong porcelain to steel adhesion, the surface must be cleaned, roughened, and a nickel coating must be applied. This is achieved by first rounding the edges which have been cut by the laser to avoid cracking of the porcelain coating at the edges of the resistor. Rounding of the edges is achieved by submerging the 10×15 inch plate into a photoengraving grade ferric chloride solution at approximately 65° C. for approximately 30 minutes. The plate is placed in a fixture which is attached to an agitating device which moves the plate slowly back and forth through the liquid forcing the liquid to pass by the edges, thereby removing some metal from the edges.

The plate is then subjected to a cleaning, roughing, and nickel plating operation. The plate is first submerged in an ultrasonically agitated degreasing solution at 100° C. for 3 minutes. The plate is then rinsed with tap water and treated to remove a small portion of the metal surface and to seal the newly exposed surface to prevent rusting. The treated plate is then submerged in an etching solution under a negative charge of approximately 100 amperes for 3 minutes, then dipped in an ultrasonically agitated deionized water tank which is at a temperature of approximately 100° C. for 10 seconds. The plate is then placed in an ammonium persulphate solution to soak for 6 minutes at which time it is removed and rinsed with tap water. The plate is then placed to soak in a nitric acid solution for another 6 minutes and then rinsed with tap water. The plate is then again treated to remove a small portion of the metal surface and to seal the newly exposed surface to prevent rusting. The part is rinsed with tap water and placed in a deionized water tank with ultrasonic agitation at a temperature of 100° C. for 10 seconds. The plate is then placed in the nickel plating flash tank and a voltage is applied. The amount of nickel coating applied to the plate is directly dependent on the amount of surface area of the plate. The plate is then rinsed off in deionized water under ultrasonic agitation for 30 seconds and rinsed in a series of isopropyl alcohol tanks to remove the water. The plate is subsequently placed in an oven to evaporate the isopropyl alcohol and dry the plate.

The porcelain coating system consists of a tank with two stainless steel electrodes spaced roughly 1.5 inches apart. The plate which is to be coated is hung by hooks in the center of the electrodes. The tank is filled with a solution of isopropyl alcohol, deionized water, and porcelain material which has been milled to about an average size of 6.0 microns. The entire coating system is controlled by a computer which continually monitors the plating voltage, weight of the coating, amperes, coulombs, solution conductivity, solution temperature, and solution density. The plate is hung on the hooks above the tank and information about the plate is entered into the computer such as the area of the plate, the porcelain slurry number, the isopropyl alcohol solution number, and the weight of the plate. The computer automatically lowers the plate into the tank and measures if the plate is centered between the electrodes. The maximum coating time is entered into the system and the coating process is initiated. The computer automatically turns the power supply on to 400 volts which excites the small particles and draws them toward the plate. Once the plate reaches a certain weight the computer automatically turns the power off and lifts the plate out of the solution. The coating time is directly related to the particle density of the solution and the surface area of the plate. The plate is then removed from the hooks and placed in a furnace at 150° C. where it is dried for approximately 15 minutes. Once the coating is dry it is fired in a batch furnace at 900° C. for approximately 10 minutes at which time it is removed and cooled at room temperature.

The porcelain coated steel is now ready to be made into a resistor by the application of the circuit, as by screen printing. In screen printing a pattern is photographically developed onto a screen. This developing leaves the pattern which is going to be applied to the substrate as an open area on the screen and the rest of the screen is filled with a polymer material. An ink is then forced through the open areas of the screen onto the substrate with a squeegee, leaving the pattern on the substrate.

The conductor is applied to the substrate first. The screen is placed on the printer as well as the porcelain coated substrate and the screen pattern and substrate are aligned. The squeegee speed, squeegee pressure, and screen substrate snap off distance are adjusted to the appropriate parameters. An appropriate amount of conductive ink is applied to the screen. The screen printer is then cycled forcing the ink through the pattern onto the substrate. Since the porcelainized plates are in an 10×15 inch plate 2 printing cycles must be performed on each plate because the screen printer used printed a maximum area of 8 inches by 8 inches. The substrate must be indexed and another cycle must occur to complete the printing of the conductor on the entire plate. The substrate is then placed on a belt dryer which slowly carries the substrate through a 150° C. heat zone in roughly 15 minutes. This drives out of the ink the volatile materials and binders which are needed during the printing process. The substrate is then placed on a belt furnace which travels through a heat zone firing the substrate at a temperature of 850° C. for 10 minutes. The substrate is then placed back on the screen printer and the resistor screen is aligned with the conductor pattern on the substrate. The resistor is printed using the correct resistive ink, dried and then fired using the same temperatures and technique described for the conductor. The substrate is placed on the screen printer to receive the dielectric resistive overglaze which is printed over the conductor and the resistor, dried and fired but at 620° C. instead of 850° C. The substrate then is placed back in the screen printer with the circuit side up and conductive traces are printed on top of the overglaze layer. The conductive traces electrically connects the termination area or the area on which the terminal will be soldered on each resistor together. This allows a way to plate the entire array of resistors at one time.

A copper plating solution is used to apply the barrier metal. I known that the silver in the conductive ink tends to migrate if such a conductive ink is directly soldered. A consequence of silver migration is separation of the conductive film from the substrate, i.e., the conductive film loses its adherence to the substrate. To avoid this a flash, or barrier metal, usually is applied over the conductive ink so soldering is with the barrier metal. Copper may be used as the barrier metal and applied from a copper plating solution. A negative electrode is hooked up to the conductive traces and a copper anode is submerged into the solution. A constant current supply is set to the correct current according to the surface area which is being plated. The copper is plated on the termination areas for approximately 30 minutes or to approximately 0.001 inches thick. The power is turned off and the copper plating solution is rinsed off with tap water. The conductive traces then are removed.

The resistors are cut out of their arrays into smaller arrays so the resistors can be laser trimmed to the appropriate resistances. A 10 watt thick film laser trimmer takes a light beam and makes a straight cut in from the edge of the resistor changing the path of the resistor and also removing a small portion of the resistor to increase its resistance. An ohm meter is hooked up to the resistor while it is being trimmed and automatically turns off once the resistor reaches the desired resistance.

The resistors are then cut out of their arrays into single resistors. High temperature solder paste is then applied to the copper plated areas of the resistors. The terminal is eyeleted to the resistor using an eyeleting machine. The resistor is heated to the temperature at which the high temperature solder melts and finally cleaned to remove the flux.

What is claimed is:

1. In a chip resistor with a continuous power density of at least 20 watts per square inch, said resistor comprising a resistive region containing a resistance element and a terminals region electrically connected to said resistance element, and having a heat conduction path from the resistive to the terminals regions, a method of reducing the heat conduction from the resistive region to the terminals region comprising location an air gap between the resistive and terminals regions, said air gap having a length sufficient to reduce the area of the heat conduction path by at least 70%.

2. The method of claim 1 where the length of the air gap is sufficient to reduce the area of the heat conduction path by at least 75%.

3. The method of claim 1 where the length of the air gap is sufficient to reduce the area of the heat conduction path by at least 80%.

4. A resistor comprising:

a. a thin planar body of generally rectangular shape with four edges and an upper and a lower surface, at least one of which is a non-conductive surface;

b. a first and a second conductive strip on a non-conductive surface of the planar body partially enclosing a resistive region and providing partial boundaries thereto;

c. a resistance element with a power density of at least about 20 watts per square inch of a film of resistance material deposited within a portion of said resistive region and in electrical contact with each of said conductive strips;

d. first and second terminals of electrically conducting material securely attached to at least one edge of the planar body and projecting laterally therefrom, e. a first electrical contact junction between the first terminal and the first conductive strip, and a second electrical contact junction between the second terminal and the second conductive strip;

f. an air gap to reduce heat flow from the resistive region to the electrical contact junctions located between the resistance element and the electrical contact junctions and having a length in the direction approximately perpendicular to the heat flow at least 70% of the width of the planar body, where the width of the planar body is the distance between opposing edges proximate to said air gap.

5. The resistor of claim 4 where the length of the air gap in the direction approximately perpendicular to the heat flow from the resistive region to the terminals is at least 80% of the width of the planar body.

6. The resistor of claim 4 where the means for reducing heat conduction is a plurality of air gaps where the sum of the lengths of the air gaps in the direction approximately perpendicular to the heat flow from the resistive region to the terminals is at least 70% of the width of the planar body, where the width of the planar body is the distance between opposing edges proximate to said air gap.

7. The resistor of claim 6 where the sum of the lengths of the air gaps in the direction approximately perpendicular to the heat flow from the resistive region to the terminals is at least 75% of the width of the planar body.

8. The resistor of claim 6 where the sum of the lengths of the air gaps in the direction approximately perpendicular to the heat flow from the resistive region to the terminals is at least 80% of the width of the planar body.

9. The resistor of claim 4 where the planar body is a ceramic or is a metal coated with a glass, a porcelain, or a metal oxide.

10. The resistor of claim 9 where the planar body is a porcelain coated metal.

11. The resistor of claim 10 where the planar body is a porcelain coated steel.

12. The resistor of claim 4 where the length of the air gap in the direction approximately perpendicular to the heat flow from the resistive region to the terminals is at least 75% of the width of the planar body.

13. A chip resistor with a continuous power density of at least 20 watts per square inch formed from a chip substrate and having a resistive region, at least one terminals region, and means for reducing heat conduction between said resistive region and each terminals region:

where said chip substrate is a thin, generally planar body of generally rectangular shape with four edges and with an upper and a lower surface, at least one of which is an electrically non-conductive surface;

where said resistive region comprises a. a first conductive strip on a non-conductive surface of the planar body proximate to a first edge of said planar body, b. a second conductive strip on said non-conductive surface proximate to a second, opposing edge of said planar body, said first and second conductive strips defining an area on said non-conductive surface bounded laterally by said conductive strips, said first and second conductive strips extending from the resistive region to the terminals region, c. a resistance element of a film of resistance material deposited on a portion of said area and in electrical contact with each of said conductive strips;

where said terminals region comprises d. first and second terminals of electrically conducting material securely attached to a third edge of the planar body and projecting laterally therefrom in an approximately co-parallel relation, e. a first electrical contact junction between the first terminal and the first conductive strip, and a second electrical contact junction between the second terminal and the second conductive strip;

and where said means for reducing heat conduction comprises at least one air gap extending from the upper to the lower surface and located i) between the resistive region and the terminals region, and ii) between the first and second conductive strip, each said air gap having a dimension z whose direction is generally perpendicular to the direction of heat flow from the resistive region to the terminals region, and where the sum of the dimensions z of each air gap is at least 70% of the distance between the first and second opposing edges in the resistive region immediately adjacent to said air gap.

* * * * *